US005319345A

United States Patent [19]

Abe et al.

[11] Patent Number: 5,319,345

[45] Date of Patent: Jun. 7, 1994

[54] VARIABLE RESISTOR

[75] Inventors: Yukinori Abe; Yuji Segawa; Kunihiko Gotoh, all of Kawasaki, Japan

[73] Assignee: Fugitsu Limited, Kawasaki, Japan

[21] Appl. No.: 959,810

[22] Filed: Oct. 13, 1992

[30] Foreign Application Priority Data

Oct. 16, 1991 [JP] Japan ..... 3-267470

[51] Int. Cl.[5] ..... H01C 10/50

[52] U.S. Cl. ..... 338/201; 338/48; 338/260; 338/295

[58] Field of Search ..... 338/260, 200, 201, 202, 338/48

[56] References Cited

U.S. PATENT DOCUMENTS 2,463,384 3/1949 Holmqvist ..... 338/201
3,089,111 5/1963 Raver et al. ..... 318/201
4,631,512 12/1986 Hishiki et al. ..... 338/202 X
4,703,302 10/1987 Hino et al. ..... 338/260 X

*Primary Examiner*—Marvin M. Lateef
*Attorney, Agent, or Firm*—Staas & Halsey

[57] ABSTRACT

A variable resistor is provided with a series resistor network including first, second and third resistor parts which are connected in series, where the second resistor part is connected to the first and third resistor parts via first and second nodes, respectively, and a fourth resistor part, coupled in parallel to the second resistor part via the first and second nodes. The fourth resistor part includes a plurality of resistors which are connected in series via a plurality of third nodes. The first resistor part has a terminal opposite the first node for receiving an input signal, and an output signal of the variable resistor is obtained via an arbitrary one of the third nodes of the fourth resistor part.

9 Claims, 8 Drawing Sheets

FIG. 6

STEPS OF 6dB

STEPS OF 0.5dB

| | $b_0$ | $b_1$ | $b_2$ | $b_3$ |
|---|---|---|---|---|
| $a_0$ | 0.0 | - 6.021 | - 12.041 | - 18.062 |
| $a_1$ | - 0.502 | - 6.522 | - 12.543 | - 18.564 |
| $a_2$ | - 1.003 | - 7.024 | - 13.045 | - 19.065 |
| $a_3$ | - 1 505 | - 7.526 | - 13.546 | - 19.567 |
| $a_4$ | - 2.007 | - 8.027 | - 14.048 | - 20.069 |
| $a_5$ | - 2.509 | - 8.529 | - 14.550 | - 20.570 |
| $a_6$ | - 3.010 | - 9.031 | - 15.051 | - 21.072 |
| $a_7$ | - 3.512 | - 9.533 | - 15.553 | - 21.574 |
| $a_8$ | - 4.014 | - 10.034 | - 16.055 | - 22.076 |
| $a_9$ | - 4.515 | - 10.536 | - 16 557 | - 22.577 |
| $a_{10}$ | - 5.017 | - 11.038 | - 17.058 | - 23.079 |
| $a_{11}$ | - 5.519 | - 11.539 | - 17.560 | - 23.581 |

UNIT (dB)

FIG.8

| | RESISTANCE | dB |
|---|---|---|
| $R_1$ | 0.67 | -0.5 |
| $R_2$ | 0.63 | -1.0 |
| $R_3$ | 0.60 | -1.5 |
| $R_4$ | 0.57 | -2.0 |
| $R_5$ | 0.53 | -2.5 |
| $R_6$ | 0.50 | -3.0 |
| $R_7$ | 0.48 | -3.5 |
| $R_8$ | 0.45 | -4.0 |
| $R_9$ | 0.43 | -4.5 |
| $R_{10}$ | 0.40 | -5.0 |
| $R_{11}$ | 0.38 | -5.5 |
| $R_{12}$ | 0.36 | -6.0 |

VARIABLE RESISTOR

BACKGROUND OF THE INVENTION

The present invention generally relates to variable resistors, and more particularly to a variable resistor which attenuates an input voltage by an arbitrary amount.

In various electronic circuits, the signal voltage is often attenuated to a desired value. An example of such a process is an attenuation of a signal having a voltage of A V by X dB. In such a process, the accuracy of the amount of the attenuation greatly affects the circuit operation, and an extremely accurate control of the attenuation is required.

FIG. 1 shows a first example of a conventional variable resistor. In FIG. 1, a plurality of resistors (nine in this case) 10 through 18 are connected in series, and a plurality of switches (fourteen in this case) 20 through 33 are coupled between nodes connecting the adjacent resistors and a non-inverting input terminal (+) of an operational amplifier 19 in a tournament connection. The switches 20 through 33 are divided into a switch group A which is made up of the switches 20 through 27, a switch group B which is made up of the switches 28 through 31, and a switch group C which is made up of the switches 32 and 33. The switch groups A, B and C are respectively controlled by control signals $S_A$, $S_B$ and $S_C$. Within each switch group, every other switches are turned ON/OFF while the remaining switches are turned OFF/ON, in response to the control signal supplied thereto. For example, the switch 21 is OFF when the switch 20 is ON, the switch 29 is OFF when the switch 28 is ON, and the switch 33 is OFF when the switch 32 is ON.

If the switches 20, 28 and 32 are ON, for example, a divided voltage $V_{10-11}$ which is obtained by a series resistor network made up of the resistors 10 through 18 is applied to the operational amplifier through these switches 20, 28 and 32. The divided voltage $V_{10-11}$ appears at the node which connects the resistors 10 and 11, and may be described by the following formula (1), where $\Sigma R_{10,,18}$ denotes a series resistance formed by all of the resistors 10 through 18, $\Sigma R_{11,,18}$ denotes a series resistance formed by the resistors 11 through 18, and $V_{IN}$ denotes an input voltage.

$$V_{10-11}=(\Sigma R_{11,,18}/\Sigma R_{10,,18})V_{IN} \quad \text{---(1)}$$

On the other hand, if the switches 27, 31 and 33 are ON, a divided voltage $V_{17-18}$ which is obtained by a series resistor network made up of the resistors 10 through 18 is applied to the operational amplifier through these switches 27, 31 and 33. The divided voltage $V_{17-18}$ appears at the node which connects the resistors 17 and 18, and may be described by the following formula (2).

$$V_{17-18}=(R_{18}/\Sigma R_{10,,18})V_{IN} \quad \text{---(2)}$$

When it is assumed for the sake of convenience that all of the resistors 10 through 18 have the same resistance R, the formulas (1) and (2) can be rewritten as the following formulas (1*a*) and (2*a*).

$$\begin{aligned} V_{10-11} &= (8R/9R)V_{IN} \\ &= (8/9)V_{IN} \approx 0.88V_{IN} \end{aligned} \quad \text{(1a)}$$

-continued $$\begin{aligned} V_{17-18} &= (R/9R)V_{IN} \\ &= (1/9)V_{IN} \approx 0.11V_{IN} \end{aligned} \quad \text{(2a)}$$

Other divided voltages $V_{114\ 12}$ through $V_{16-17}$ between the divided voltages $V_{10-11}$ and $V_{17-18}$ can be obtained in a similar manner, and the following relationship can be obtained.

$$V_{11-12}=(7/9)V_{IN}\approx 0.77V_{IN}$$

$$V_{12-13}=(6/9)V_{IN}\approx 0.66V_{IN}$$

$$V_{13-14}=(5/9)V_{IN}\approx 0.55V_{IN}$$

$$V_{14-15}=(4/9)V_{IN}\approx 0.44V_{IN}$$

$$V_{15-16}=(3/9)V_{IN}\approx 0.33V_{IN}$$

$$V_{16-17}=(2/9)V_{IN}\approx 0.22V_{IN}$$

Accordingly, the variable resistor shown in FIG. 1 can vary the attenuation from 0.11 times to 0.88 times depending on the combination of the control signals $S_A$, $S_B$ and $S_C$, and an output voltage $V_{OUT}$ of the operational amplifier 19 can be varied in steps.

However, according to the first example of the conventional variable resistor, the voltage varying width is determined by the voltage dividing width of the series resistor network. For this reason, if an attempt is made to improve the resolution by making the voltage varying width small, the number of required resistors and switches becomes extremely large, and there is a problem in that the circuit scale becomes extremely large.

FIG. 2 shows a second example of a conventional variable resistor. In FIG. 2, a first series resistor group 44 is made up of a plurality of resistors (four in this case) 40 through 43 and functions as an input resistance Rs of an operational amplifier 45. Similarly, a second series resistor group 50 is made up of a plurality of resistors (four in this case) 46 through 49 and functions as a feedback resistance Rf of the operational amplifier 45. The operational amplifier 45 operates as an inverting amplifier and an amplification $A_{NF}$ thereof is determined by a ratio of the resistances Rs and Rf, that is, $A_{NF}=-Rf/Rs$. Switches 51 through 56 are provided with respect to the first and second series resistor groups 44 and 50. Control signals $S_{s1}$ through $S_{s3}$ and $S_{f1}$ through $S_{f3}$ are supplied to these switches 51 through 56, and all of the switches 51 through 56 are turned OFF or only one switch with respect to each of the first and second series resistor groups 44 and 50 is selectively turned ON in response to the control signals $S_{s1}$ through $S_{s3}$ and $S_{f1}$.

When all of the switches 51 through 56 are OFF, the input resistance Rs has a maximum resistance $\Sigma R_{40,,43}$ of the first series resistor group 44 and the feedback resistance Rf has a maximum resistance $\Sigma R_{46,,49}$ of the second series resistor group 50.

If it is assumed for the sake of convenience that all of the resistors 40 through 43 and 46 through 49 have the same resistance R, the maximum resistances $\Sigma R_{40,,43}$ and $\Sigma R_{46,,49}$ can both be described by 4R. Hence, the amplification $A_{NF}$ is $-4R/4R=-1$. On the other hand, if only the switch 53 provided with respect to the first series resistor group is turned ON, the amplification $A_{NF}$ is $-4R/R=-4$.

Accordingly, by appropriately setting the resistances $R_{40}$ through $R_{43}$ and $R_{46}$ through $R_{49}$ of the resistors 40 through 43 and 46 through 49, it is possible to switch the amplification $A_{NF}$ of the operational amplifier 45 in multi-steps depending on the control signals $S_{s1}$ through $S_{s3}$ and $S_{f1}$ through $S_{f3}$. In other words, the output voltage $V_{OUT}$ of the operational amplifier 45 can be varied in steps.

However, according to the second example of the variable resistor, metal oxide semiconductor (MOS) transistors are used for the switches 51 through 56 which are provided with respect to the first and second series resistor groups 44 and 50 in order to obtain a sufficiently high switching speed. As a result, the ONON-resistances of the MOS transistors affect the input resistance Rs and the feedback resistance Rf, and there is a problem in that the amplification $A_{NF}$ of the operational amplifier 45 becomes inaccurate.

FIG. 3 shows a third example of the conventional variable resistor. In FIG. 3, a first voltage dividing circuit 60 is made up of a plurality of resistors 61 through 65 and switches 66 through 71. This first voltage dividing circuit 60 is used to obtain a volta $V_{60}$ by dividing the input voltage $V_{IN}$ by an ON/OFF combination of the switches 66 through 71. For example, if the switches 66 and 70 are ON and the other switches are OFF, the voltage $V_{60}$ becomes a maximum. On the other hand, the voltage $V_{60}$ becomes a minimum if the switches 69 and 71 are ON and the other switches are OFF.

A second voltage dividing circuit 80 is made up of a plurality of resistors 81 through 85 and switches 86 through 91. This second voltage dividing circuit 80 varies the ratio of the input resistance Rs and the feedback resistance Rf of an operational amplifier 92 so as to vary the amplification $A_{NF}$. For example, if the switches 86 and 90 are ON and the other switches are OFF, the input resistance Rs becomes the series resistance of the resistors 82 through 85, the feedback resistance Rf becomes the resistance of the resistor 81, and the amplification $A_{NF}$ becomes a minimum because the ratio Rf/Rs becomes a minimum. On the other hand, if the switches 89 and 91 are ON and the other switches are OFF, the input resistance Rs becomes the resistance of the resistor 85, the feedback resistance Rf becomes the series resistance of the resistors 81 through 84, and the amplification $A_{NF}$ becomes a maximum because the ratio Rf/Rs becomes a maximum.

According to this third example of the variable resistor, the input voltage $V_{IN}$ can be varied in four steps by the first voltage dividing circuit 60, and the amplification $A_{NF}$ of the operational amplifier 92 can be varied in four steps by the second voltage dividing circuit 80. For this reason, it is possible to obtain the output voltage $V_{OUT}$ by adjusting the input voltage $V_{IN}$ in sixteen ($=4\times4$) steps by appropriately switching the ON/OFF combination of the switches provided with respect to the first and second voltage dividing circuits 60 and 80. Compared to the first example of the variable resistor, it is possible to make the circuit scale smaller.

In addition, the current flowing to the second voltage dividing circuit 80 mainly flows through the resistors 81 through 85 and only an extremely small current flows through the switches 86 through 91. Hence, even if MOS transistors are used for the switches 86 through 91, it is possible to suppress the voltage drop generated by the ON-resistances of the MOS transistors. Accordingly, it is possible to accurately adjust the amplification $A_{NF}$ of the operational amplifier 92, and the problems of the second example of the variable resistor can be suppressed.

However, according to the third example of the variable resistor, the voltage $V_{60}$ obtained from the first voltage dividing circuit 60 is variably amplified in the operational amplifier 92 with the amplification $A_{NF}$ which is set by the second voltage dividing circuit 80. As a result, an offset voltage of the operational amplifier 92 which is added to the voltage $V_{60}$ is also subjected to the variable amplification, and there is a problem in that the offset voltage varies depending on a code which is set to control the ON/OFF states of the switches which are provided with respect to the first and second voltage dividing circuits 60 and 80. The code sets the ratio $V_{IN}/V_{OUT}$.

A more detailed description will be given of the offset voltage. Generally, the operational amplifier which is used as a comparator is made up of a differential amplifier circuit formed by a transistor pair having the same characteristic. However, because it is extremely difficult to make a transistor pair having perfectly identical characteristics, an offset voltage is inevitably generated by the difference in the characteristics of the transistor pair. The offset voltage is the voltage which appears at the output when the input of the operational amplifier is zero, and is normally described by a value $V_{OS}$ which is converted to the input. In other words, it is regarded that a voltage corresponding to the value $V_{OS}$ is input to the input terminal of the operational amplifier. Therefore, since the regular input voltage in ($V_{60}$ in FIG. 3) is inevitably amplified by this value $V_{OS}$, there is a problem in that the accuracy of the variable resistor which attenuates the input voltage $V_{IN}$ to an arbitrary output voltage $V_{OUT}$ cannot be improved.

SUMMARY OF THE INVENTION

Accordingly, it is a general object of the present invention to provide a novel and useful variable resistor in which the above described problem of the offset voltage is eliminated.

Another and more specific object of the present invention is to provide a variable resistor comprising a series resistor network including first, second and third resistor parts which are connected in series, where the second resistor part is connected to the first and third resistor parts via first and second nodes, respectively, and a fourth resistor part, coupled in parallel to the second resistor part via the first and second nodes, where the fourth resistor part includes a plurality of resistors which are connected in series via a plurality of third nodes, the first resistor part has a terminal opposite the first node for receiving an input signal, and an output signal of the variable resistor is obtained via an arbitrary one of the third nodes of the fourth resistor part. According to the variable resistor of the present invention, it is possible to accurately control the amount of attenuation of the input signal using a relatively small circuit scale. Furthermore, the conventional problem of the offset voltage of the operational amplifier is eliminated because the present invention does not use an operational amplifier for adjusting the amplification.

Other objects and further features of the present invention will be apparent from the following detailed description when read in conjunction with the accompanying drawings.

BRIEF DESCRIPTION OF THE DRAWINGS

FIG. 6 is a diagram for explaining an attenuation (gain) of the embodiment shown in FIG. 5;

FIG. 8 is a diagram for explaining desirable resistances of a fourth resistor part of the embodiment.

DESCRIPTION OF THE PREFERRED EMBODIMENTS

First, a description will be given of the operating principle of the present invention, by referring to FIG. 4.

Figure 1:
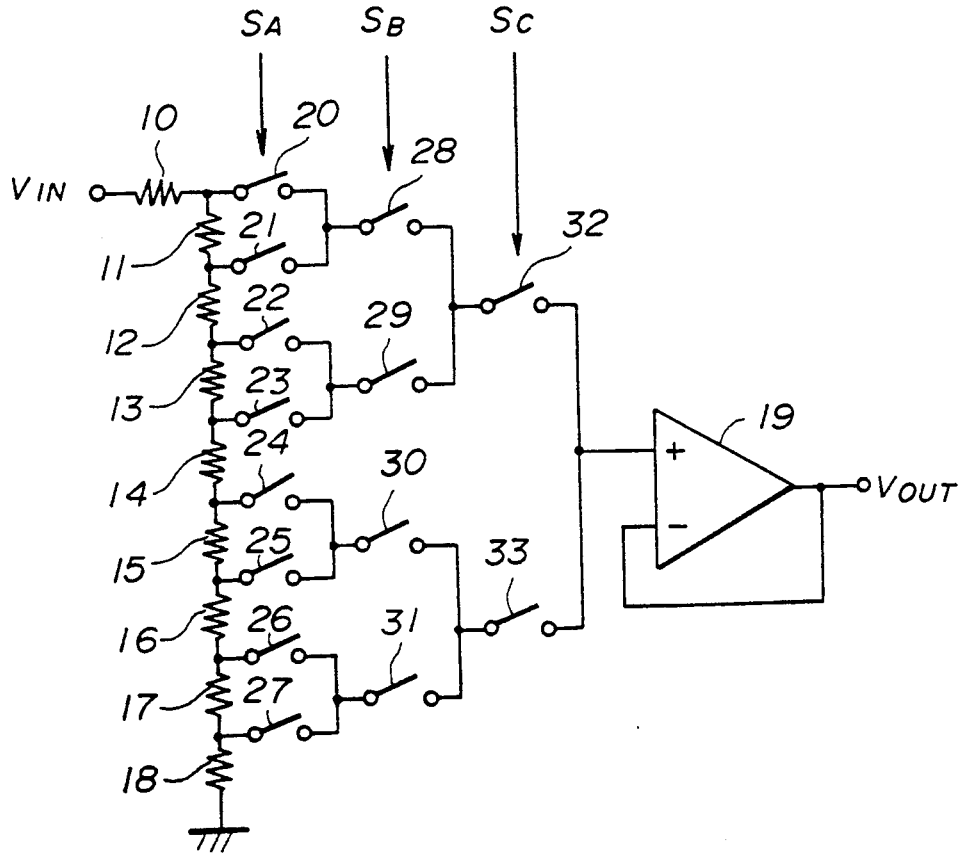
FIG. 1 PRIOR ART
FIG. 1 is a circuit diagram showing a first example of a conventional variable resistor.
Figure 2:
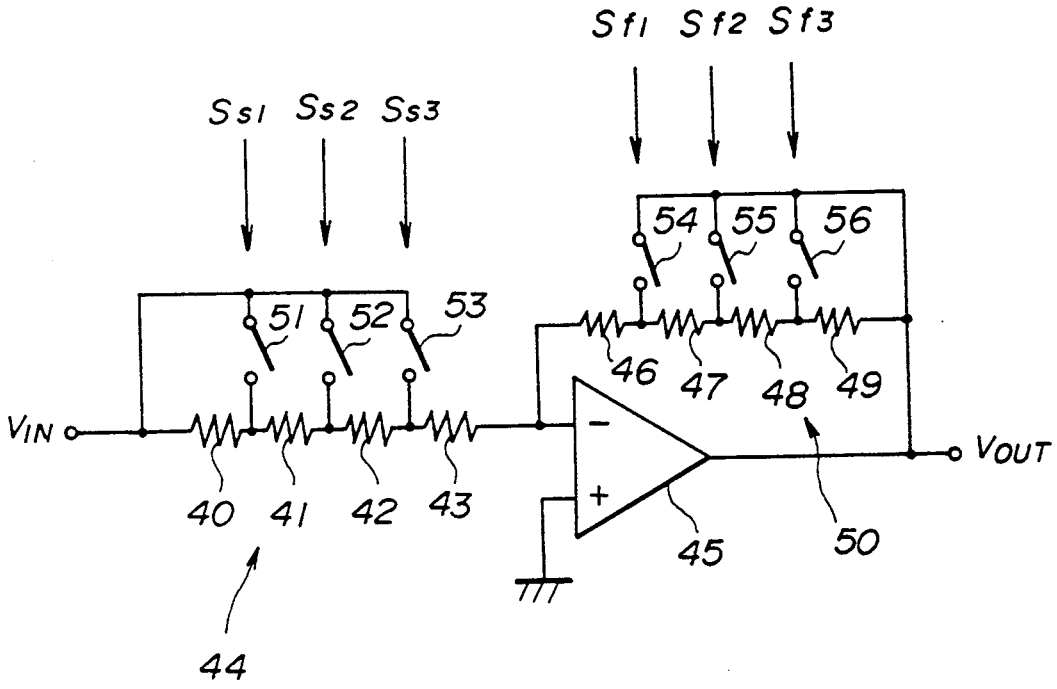
FIG. 2 PRIOR ART
FIG. 2 is a circuit diagram showing a second example of the conventional variable resistor.
Figure 3:
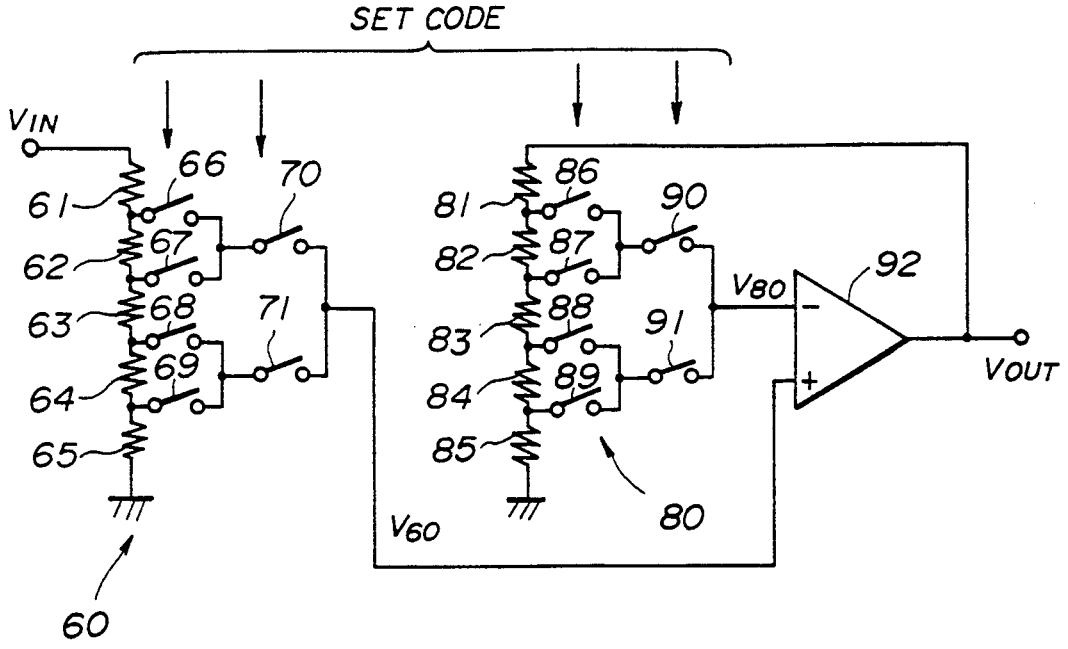
FIG. 3 PRIOR ART
FIG. 3 is a circuit diagram showing a third example of the conventional variable resistor.
Figure 4A:
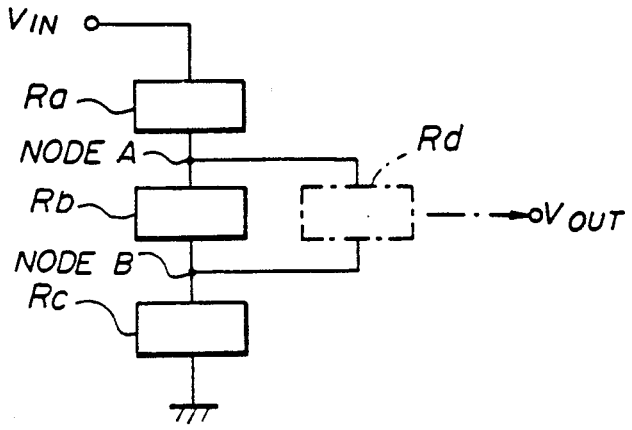
FIGS. 4(*a*) and 4(*b*) are diagrams for explaining the operating principle of the present invention.
Figure 4B:
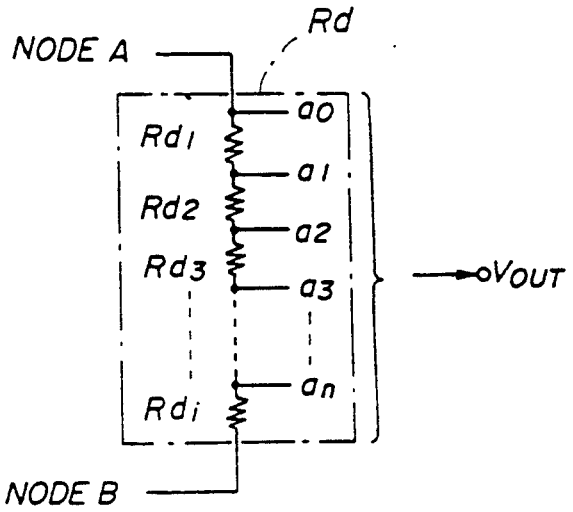

In FIG. 4 (*a*), a first resistor part Ra, a second resistor part Rb and a third resistor part Rc are connected in series. In addition, a fourth resistor part Rd is connected in parallel to the second resistor part Rb. An input voltage $V_{IN}$ is applied to the series resistor network which is made up of the first, second and third resistor parts Ra, Rb and Rc. The fourth resistor part Rd is made up of a plurality of resistors Rd1, . . . , Rdi which are connected in series as shown in FIG. 4 (*b*), and an output voltage $V_{OUT}$ is obtained from a node which connects two adjacent resistors within the fourth resistor part Rd.

The output voltage $V_{OUT}$ undergoes a first change by changing the value of the first resistor part Ra. In addition, the output voltage $V_{OUT}$ undergoes a second change which is finer that the first change, by changing the node via which the output volta $V_{OUT}$ is obtained from the fourth resistor part Rd.

A combined resistance of the first, second, third and fourth resistor parts Ra, Rb, Rc and Rd can be obtained from the following formula (3).

$$Ra+[Rb\times Rd/(Rb+Rd)]+Rc \quad \text{---(3)}$$

If it is assumed for the sake of convenience that Ra=Rb=Rc=Rd=1 Ω, the formula (3) can be rewritten as the following formula (4), and the combined resistance becomes 2.5 Ω.

$$1+[1\times 1/(1+1)]+1=1+0.5+1 \quad \text{---(4)}$$

A voltage $V_A$ which appears at a node A can be described by the following formula (5), while a voltage $V_B$ which appears at a node B can be described by the following formula (6).

$$V_A=[0.5+1)/2.5]V_{IN}=0.6V_{IN} \quad \text{---(5)}$$

$$V_B=(1/2.5)V_{IN}=0.4V_{IN} \quad \text{---(6)}$$

The potential difference $0.6V_{IN}-0.4V_{IN}$ between the voltages $V_A$ and $V_B$ is divided into a plurality of voltages $a_1, \ldots, a_n$, and a voltage $V_B+a_m$ is obtained as the output voltage $V_{OUT}$, where m=1, . . . , m. In other words, the potential difference between the voltages $V_A$ and $V_B$ is adjusted by the first change, and the value of m of the voltage $a_m$ is adjusted by the second change.

Accordingly, it is possible to roughly adjust the output volta $V_{OUT}$ by the first change, and finely adjust the output voltage $V_{OUT}$ by the second change. For this reason, it is possible to minimize the circuit scale and realize an accurate voltage attenuation. The above described problem caused by the offset voltage of the operational amplifier will not occur in the present invention because the present invention does not require an operational amplifier.

Next, a description will be given of an embodiment of the variable resistor according to the present invention, by referring to FIGS. 5 through 8.

Figure 5:
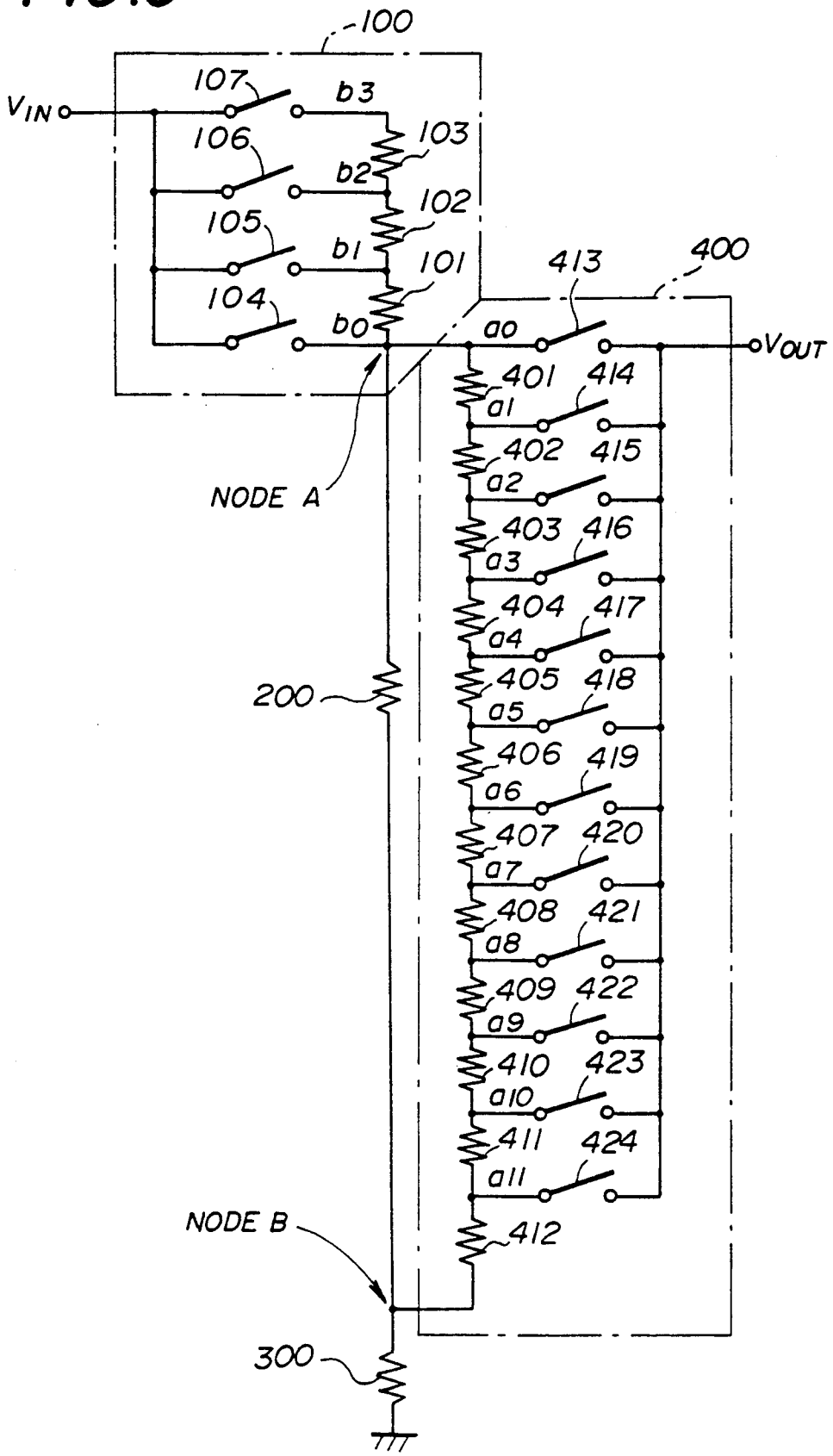
FIG. 5 is a circuit diagram showing an embodiment of a variable resistor according to the present invention.

FIG. 5 shows this embodiment. In FIG. 5, a first resistor part 100, a second resistor part 200, a third resistor part 300 and a fourth resistor part 40 respectively correspond to the first, second, third and fourth resistor parts Ra, Rb, Rc and Rd shown in FIG. 4. The first, second and third resistor parts 100, 200 and 300 are connected in series. In addition, the fourth resistor part 400 is connected in parallel to the second resistor part 200 at the nodes A and B.

The first resistor part 100 includes three resistors 101, 102 and 103 which are connected in series and respectively have resistances 2R, 4R and 8R Ω, and four switches 104 through 107 which are connected as shown. By selectively turning ON one of the switches 104 through 107, a basic resistance RA is switched to 0, 1, 3 and 7 times, where RA is 2R Ω, for example. In other words, the resistance is 0×Ra=0 Ω is the switch 104 is turned ON, the resistance is 1×RA=2R Ωif the switch 105 is turned ON, the resistance is 3×RA=6R Ω if the switch 106 is turned ON, and the resistance is 7×RA=14R Ω if the switch 107 is turned ON. When a coefficient of the basic resistance RA is denoted by $b_x$, the above four resistances can be described by $b_0$RA, $b_1$RA, $b_2$RA and $b_3$RA Ω. The general expression describing the resistance of the first resistor part 100 is thus $b_x$RA Ω.

For example, the resistance of the third resistor part 300 and the combined resistance of the second and fourth resistor parts 200 and 400 respectively are R Ω. In addition, the fourth resistor part 400 is made up of twelve resistors 401 through 412 respectively having resistances in a range of 0.6 to 0.3 Ω, for example, and switches 413 through 424. These resistors 401 through 412 correspond to the resistors Rd1 through Rdi shown in FIG. 4 for the case where i=12. In this embodiment, the potential difference between the nodes A and B is divided in fine steps by the resistors 401 through 412 to voltages $a_0$ through $a_{11}$. By selectively turning ON one of the switches 413 through 424, it is possible to obtain one of the divided voltages $a_0$ through $a_{11}$ when outputting the output voltage $V_{OUT}$.

A voltage $V_{AOUT}$ which appears at the node A can be described by the following formula (7), where $b_x$RA is the general expression of the resistance of the first resistor part 100, RB denotes the resistance of the second resistor part 200, RC denotes the resistance of the third resistor part 300, and RD denotes the resistance of the fourth resistor part 400.

$$V_{AOUT}=[RB\times RD/(RB+RD)+RC]V_{IN}/]b_x\cdot RA+[RB\times RD/(RB+RD)]+RC] \quad \text{---(7)}$$

If it is assumed for the sake of convenience that RA=RB×RD/(RB+RD)=RC=O Ω, the formula (7) above can be rewritten as the following formula (8).

$$V_{AOUT} = [2P/(b_xP + 2P)]V_{IN} = [2P/P(b_x + 2)]V_{IN} = [2/(b_x + 2)]V_{IN} \quad (8)$$

A voltage gain $G_A$ at the node A can be described by the following formula (9).

$$G_A = 20\log(V_{AOUT}/V_{IN}) = 20\log[2/(b_x + 2)]\ [dB] \quad (9)$$

On the other hand, a voltage $V_{BOUT}$ which appears at the node B can be described by the following formula (10).

$$V_{BOUT} = Rc \times V_{IN}/[b_xRA + [RB \times RD/(RB + RD)] + RC] = [1/(b_x + 2)]V_{IN} \quad (10)$$

Thus, a voltage gain $G_B$ at the node B can be described by the following formula (11).

$$G_B = 20\log[1/(b_x + 2)][dB] \quad \text{---(11)}$$

If the divided voltage at the fourth resistor part 400 is equally divided by the decibel [dB] value, the difference in the decibel values among the divided voltages $a_0$ through $a_{11}$ can be obtained from the following formula (12), where i denotes the maximum number of divisions made in the fourth resistor part 400 and i=11 in this embodiment.

$$[G_A - G_B) \times 1/i \quad \text{---(12)}$$

A voltage gain GAIN of the output voltage $V_{OUT}$ can thus be described by the following formula (13), where $a_n = a_0, a_1, \ldots, a_{11}$.

$$GAIN = G_A - (G_A - (G_A - G_B) \times a_n/i[dB] \quad \text{---(13)}$$

The above formula (13) can be transformed into the following formula (14), where $b_x = 2^{n+1} - 2$ ($n \geqq 0$), $a_n = n$, $a_n$ ($n = 0, \ldots, i-1$), and n and i are integers.

$$GAIN = 20\log[2/b_x + 2)] + (20a_n/i)\log 2 \quad \text{---(14)}$$

therefore, by changing the resistance of the first resistor part 100 from $b_0$RA to $b_3$RA, it is possible to make a rough adjustment of the gain GAIN, that is, adjust the gain GAIN in large steps. In addition, by switching the divided voltages $a_0$ through $a_{11}$ of the fourth resistor part 400, it is possible to make a fine adjustment of the gain GAIN, that is, adjust the gain GAIN in fine steps.

FIG. 6 shows the gain GAIN which can be obtained when the first resistor part 100 is made up of the resistors 101 through 103 respectively having the resistances of 2R, 4R and 8R Ω, the resistance of the third resistor part 300 and the combined resistance of the second and fourth resistor parts 200 and 400 respectively are R Ω, and the divided voltages obtainable from the fourth resistor part 400 is equally divided by the decibel value. In FIG. 6, the column direction corresponds to $b_0$RA through $b_3$RA, and the row direction corresponds to $a_0$ through $a_1$.

As may be seen from FIG. 6, the gain GAIN can be change in steps of 6 dB by changing $b_0$RA through $b_3$RA. In addition, it is possible to change the gain GAIN in steps of 0.5 dB by changing $a_0$ through $a_{11}$. In other words, it is possible to make a rough adjustment in steps of 6 dB from 0 dB to −18 dB, and to make a fine adjustment in steps of 0.5 dB from 0 dB to −5.5 dB. Hence, this embodiment may be applied to a digitally controlled variable gain circuit (so-called electronic volume unit) to realize the accurate attenuation by the rough and fine adjustments (first and second changes).

Figure 7:
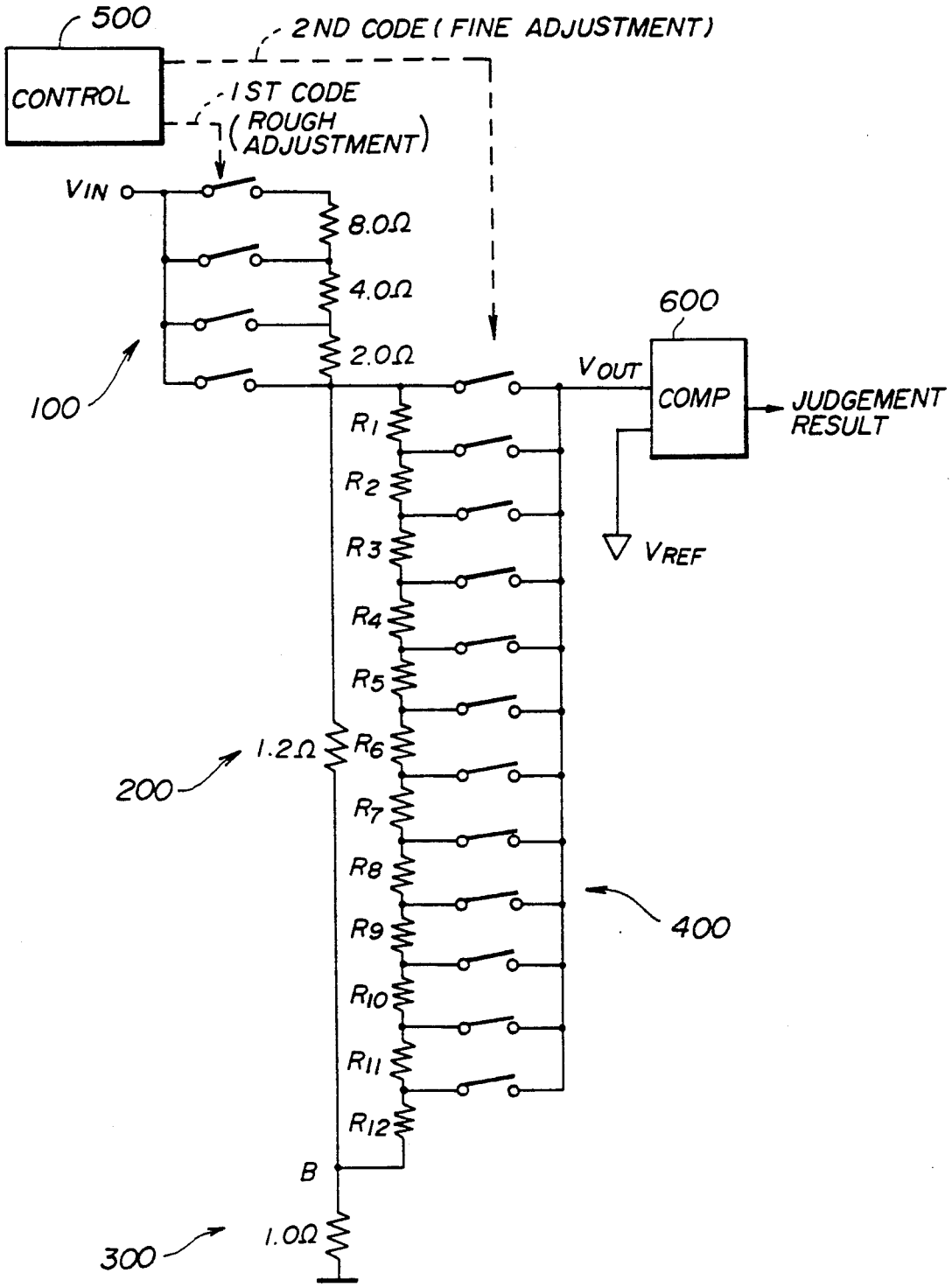
FIG. 7 is a circuit diagram showing the embodiment together with peripheral circuits thereof.

FIG. 7 shows this embodiment together with peripheral circuits thereof. In FIG. 7, the resistors 101, 102 and 103 of the first resistor part 100 respectively have the resistances of 2.0, 4.0 and 8.0 Ω. The second resistor part 200 is made up of a resistor having the resistance of 1.2 Ω, and the third resistor part 300 is made up of a resistor having the resistance of 1.0 Ω. Furthermore, the resistors 401 through 412 of the fourth resistor part 400 respectively have the resistances $R_1$ and $R_{12}$ shown in FIG. 8. In FIG. 8, the right-hand side of each resistance indicates the attenuation obtained thereby.

A control circuit 500 sets a first code which appropriately controls the ON/OFF states of the switches 104 through 107 and determines the resistance of the first resistor part 100. In addition, the control circuit 500 sets a second code which appropriately controls the ON/-OFF states of the switches 413 through 424 and determines the divided voltage (that is, the resistance) of the fourth resistor part 400. The input voltage $V_{IN}$ is attenuated by an amount which is roughly determined by the first resistor part 100 and finely determined by the fourth resistor part 400, and the output volta $V_{OUT}$ having the gain GAIN is output to a comparator 600.

The comparator 600 compares the output voltage $V_{OUT}$ with a reference volta $V_{REF}$, and a result of this comparison is output as a judgement result from the comparator 600. For example, if $V_{IN}$=10 V and $V_{REF}$=1.5 V, the gain GAIN obtained from FIG. 6 is −13.546 dB for $b_2$ and $a_3$ and $V_{OUT}$=2.1 V. In this case, the judgement result of the comparator 600 indicates that $V_{OUT} < V_{REF}$. Therefore, the circuit shown in FIG. 7 functions as a digitally controlled variable gain circuit (electronic volume).

In this embodiment, the attenuation (or gain) of the input voltage $V_{IN}$ is roughly adjusted in steps of 6 dB by changing the resistance of the first resistor part 100, and the attenuation (or gain) of the input voltage $V_{IN}$ is finely adjusted in steps of 0.5 dB by changing the node via which the divided voltage is obtained from the fourth resistor part 400. Hence, the varying range of the attenuation (or gain) can be set large by combining the rough and fine adjustments, and the adjustments can be made accurately.

In addition, the amount of attenuation is actually given by the product of the number of rough adjusting steps (four steps in the case of $b_0$ through $b_3$) and the number of fine adjusting steps (twelve in the case of $a_0$ through $a_{11}$). Therefore, the amount of attenuation in this embodiment can be selected arbitrarily from forty-eight values. Compared to the number of resistors used (seventeen resistors in the case of this embodiment), it is possible to obtain a very large number of values for the amount of attenuation and the circuit scale can be suppressed.

Moreover, because no operational amplifier is used to vary the amplification, the above described problem of the offset voltage of the operational amplifier is completely eliminated according to the present invention. Thus, the present invention can realize an extremely accurate electronic volume unit.

Further, the present invention is not limited to these embodiments, but various variations and modifications may be made without departing from the scope of the present invention.

What is claimed is:

1. A variable resistor comprising:

a series resistor network including first, second and third resistor parts which are connected in series, said second resistor part being connected to the first and third resistor parts via first and second nodes, respectively; and a fourth resistor part, coupled in parallel to the second resistor part via the first and second nodes, said fourth resistor part including a plurality of resistors which are connected in series via a plurality of third nodes, said first resistor part having a terminal opposite the first node for receiving an input signal, an output signal of the variable resistor being obtained via an arbitrary one of the third nodes of said fourth resistor part.

2. The variable resistor as claimed in claim 1, wherein said first resistor part includes a plurality of resistors which are connected in series and switching means for passing the input signal through an arbitrary number of resistors of said first resistor part, said arbitrary number including zero.

3. The variable resistor as claimed in claim 2, wherein an amount of attenuation of the input signal in said first resistor part is greater than an amount of attenuation of the input signal in said fourth resistor part.

4. The variable resistor as claimed in claim 3, wherein the amount of attenuation is variable by said first resistor part in first steps, the amount of attenuation is variable by said fourth resistor part in second steps, said first steps being greater than the second steps.

5. The variable resistor as claimed in claim 2, wherein a potential difference between the first and second nodes is adjusted by changing the resistance of said first resistor part with respect to the input signal, the output voltage is $V_B+a_m$ when the potential at the second node is denoted b $V_B$ and divided voltages at each of the third nodes are denoted by $a_m$, where $m=1, \ldots, n$ and n is an integer, and a value of m is adjusted by changing the arbitrary third node in said fourth resistor part.

6. The variable resistor as claimed in claim 5, wherein an amount of attenuation of the input signal in said first resistor part is greater than an amount of attenuation of the input signal in said fourth resistor part.

7. The variable resistor as claimed in claim 6, wherein the amount of attenuation is variable by said first resistor part in first steps, the amount of attenuation is variable by said fourth resistor part in second steps, said first steps being greater than the second steps.

8. The variable resistor as claimed in claim 5, wherein said fourth resistor part further includes switching means for passing the input signal obtained via said first resistor part through an arbitrary number of resistors of said fourth resistor part so as to determine the arbitrary third node.

9. The variable resistor as claimed in claim 1, wherein said fourth resistor part further includes switching means for passing the input signal obtained via said first resistor part through an arbitrary number of resistors of said fourth resistor part so as to determine the arbitrary third node.

* * * * *

UNITED STATES PATENT AND TRADEMARK OFFICE

CERTIFICATE OF CORRECTION

PATENT NO. : 5,319,345

DATED : June 7, 1994

INVENTOR(S) : YUKINORI ABE et al.

It is certified that error appears in the above-indentified patent and that said Letters Patent is hereby corrected as shown below:

Title page, [73], delete "Fugitsu" and substitute --Fujitsu--.

Column 1, line 66, before "(1a)" insert -- --- --.

Column 2, line 3, before "(2a)" insert -- --- --;

line 7, delete "$V_{11412}$" and substitute --$V_{11-12}$--.

Column 3, line 17, delete "ONON-resistances" and substitute --ON-resistances--.

*Column 5, line 40, delete "that" and substitute --than--;

* line 60, before "1)" insert --(--;

line 67, delete "m" and substitute --n--.

Column 6, line 4, delete "volta" and substitute --voltage--;

line 17, delete "40" and substitute --400--' line 68, delete "O" and substitute --P--.

Column 7, line 5, before "(8)" insert -- --- --;

line 13, before "(9)" insert -- --- --;

UNITED STATES PATENT AND TRADEMARK OFFICE

CERTIFICATE OF CORRECTION

PATENT NO. : 5,319,345

DATED : June 7, 1994

INVENTOR(S) : YUKINORI ABE et al.

It is certified that error appears in the above-indentified patent and that said Letters Patent is hereby corrected as shown below:

line 21, before "(10)" insert -- --- --;

line 28, delete "$B_B$ = 2011og[1/($b_x$+s)][dB]" and substitute --$G_B$ 201og[1/($b_x$+2)][dB]--.

* line 38, delete "0" and substitute --]--;

line 44, delete "GAIN = $G_A$-($G_A$-$G_B$)x$a_n$[dB]" and substitute --GAIN = $G_A$-($G_A$-=$G_B$)x$a_n$/i[dB]--;

line 49, delete "GAIN = 2011og[2/$b_x$+s)]+(20$a_n$/i)log2" and substitute --GAIN = 201og[2/$b_x$+2]+(202$_n$/i)log2-- line 51, delete "therefore" and substitute --Therefore--;

line 68, delete "$a_1$" and substitute --$a_{11}$--.

*Column 8, line 2, delete "change" and substitute --changed--;

line 20, delete "and" and substitute --through--;

line 27, delete "ON/-" and substitute --ON/--;

UNITED STATES PATENT AND TRADEMARK OFFICE

CERTIFICATE OF CORRECTION

PATENT NO. : 5,319,345

DATED : June 7, 1994

INVENTOR(S) : YUKINORI ABE et al.

It is certified that error appears in the above-indentified patent and that said Letters Patent is hereby corrected as shown below:

line 33, delete "volta" and substitute --voltage--;

line 36, delete "volta" and substitute --voltage-- line 39, delete "1.5" and substitute --2.5--.

Signed and Sealed this

Twenty-fifth Day of October, 1994

*Attest:*

*Attesting Officer*

Bruce Lehman

BRUCE LEHMAN

*Commissioner of Patents and Trademarks*